US007244079B1

(12) United States Patent
Blomquist et al.

(10) Patent No.: US 7,244,079 B1
(45) Date of Patent: Jul. 17, 2007

(54) RETAINING WALL SYSTEM

(75) Inventors: Peter J. Blomquist, Melbourne Beach, FL (US); Todd P. Strand, Marine on St. Croix, MN (US)

(73) Assignee: Kiltie Corporation, Oakdale, MN (US)

( * ) Notice: Subject to any disclaimer, the term of this patent is extended or adjusted under 35 U.S.C. 154(b) by 0 days.

(21) Appl. No.: 11/227,369

(22) Filed: Sep. 15, 2005

Related U.S. Application Data

(63) Continuation of application No. 10/230,025, filed on Aug. 28, 2002, now Pat. No. 6,960,048, which is a continuation of application No. 09/479,521, filed on Jan. 7, 2000, now Pat. No. 6,488,448, which is a continuation-in-part of application No. 29/112,442, filed on Oct. 15, 1999, now abandoned, and a continuation-in-part of application No. 29/112,434, filed on Oct. 15, 1999, now Pat. No. Des. 435,302.

(51) Int. Cl.
*E02D 5/20* (2006.01)

(52) U.S. Cl. ..... 405/284; 52/604; 52/612

(58) Field of Classification Search ..... 52/596, 52/604, 612; 405/284, 285; D25/113
See application file for complete search history.

(56) References Cited

U.S. PATENT DOCUMENTS

| | | | | |
|---|---|---|---|---|
| 228,052 | A | 5/1880 | Frost | |
| 415,772 | A | 11/1889 | Fiske | |
| 468,838 | A | 2/1892 | Steiger | |
| D22,609 | S * | 7/1893 | Deslauriers | D25/151 |
| D22,610 | S | 7/1893 | Deslauriers | |
| D67,647 | S | 6/1925 | Dunn | |
| 1,857,995 | A | 5/1932 | Alles et al. | |

(Continued)

FOREIGN PATENT DOCUMENTS

| | | |
|---|---|---|
| CA | 531354 | 10/1856 |

(Continued)

OTHER PUBLICATIONS

Garden Rockery Retaining Wall System, "The Natural Garden", Pacific Precast Products Ltd., 1998.

(Continued)

*Primary Examiner*—Gary S. Hartmann
(74) *Attorney, Agent, or Firm*—Gerald E. Helget; Nelson R. Capes; Briggs and Morgan, P.A.

(57) ABSTRACT

A retaining wall system is comprised of a plurality of courses of side-by-side parallelogram front face patterns, each parallelogram front face pattern formed by first and second rows of a plurality of quadrilateral face patterns. The first and second rows of the plurality of quadrilateral face patterns have the same width and collectively define a height of the parallelogram front face pattern, with each of the parallelogram front face patterns having the same height. The quadrilateral face patterns in the first row have a width different than that of the quadrilateral face patterns in the second row. Each parallelogram front face pattern in a first course overlies two parallelogram front face patterns in an immediately adjacent course. The combination of off-sets of the quadrilateral face patterns in each parallelogram front face pattern and overlapping of parallelogram face patterns in adjacent courses creates a retaining wall having a non-uniform appearance of a natural stone wall.

17 Claims, 14 Drawing Sheets

U.S. PATENT DOCUMENTS

| | | | |
|---|---|---|---|
| 2,235,646 | A | 3/1941 | Schaffer |
| D134,608 | S | 12/1942 | Larson |
| 2,313,363 | A | 3/1943 | Schmitt |
| 2,371,201 | A | 3/1945 | Wells |
| 3,036,407 | A | 5/1962 | Dixon |
| 3,783,566 | A | 1/1974 | Nielson |
| 3,925,994 | A | 12/1975 | Broms et al. |
| 3,936,987 | A | 2/1976 | Calvin |
| 3,953,979 | A | 5/1976 | Kurose |
| 4,083,190 | A | 4/1978 | Pey |
| 4,107,894 | A | 8/1978 | Mullins |
| 4,110,949 | A | 9/1978 | Cambiuzzi et al. |
| 4,175,888 | A | 11/1979 | Ijima |
| 4,190,384 | A | 2/1980 | Neumann |
| 4,193,718 | A | 3/1980 | Wahrendorf et al. |
| 4,207,718 | A | 6/1980 | Schaaf et al. |
| 4,228,628 | A | 10/1980 | Schlomann |
| 4,262,463 | A | 4/1981 | Hapel |
| 4,312,606 | A | 1/1982 | Sarikelle |
| 4,337,605 | A | 7/1982 | Tudek |
| 4,454,699 | A | 6/1984 | Strobl |
| 4,490,075 | A | 12/1984 | Risi et al. |
| 4,512,685 | A | 4/1985 | Hegle |
| D279,030 | S | 5/1985 | Risi et al. |
| D280,024 | S | 8/1985 | Risi et al. |
| 4,565,043 | A | 1/1986 | Mazzarese |
| 4,651,485 | A | 3/1987 | Osborne |
| 4,660,342 | A | 4/1987 | Salisbury |
| D295,788 | S | 5/1988 | Forsberg |
| D296,007 | S | 5/1988 | Forsberg |
| D296,365 | S | 6/1988 | Forsberg |
| D297,464 | S | 8/1988 | Forsberg |
| D297,574 | S | 9/1988 | Forsberg |
| D297,767 | S | 9/1988 | Forsberg |
| 4,784,821 | A | 11/1988 | Leopold |
| D299,067 | S | 12/1988 | Forsberg |
| 4,802,320 | A | 2/1989 | Forsberg |
| 4,815,897 | A | 3/1989 | Risi et al. |
| 4,825,619 | A | 5/1989 | Forsberg |
| 4,884,921 | A | 12/1989 | Smith |
| D311,444 | S | 10/1990 | Forsberg |
| 4,964,761 | A | 10/1990 | Rossi |
| D317,048 | S | 5/1991 | Forsberg |
| 5,017,049 | A | 5/1991 | Sievert |
| D319,885 | S | 9/1991 | Blomquist et al. |
| 5,044,834 | A | 9/1991 | Janopaul, Jr. |
| D321,060 | S | 10/1991 | Blomquist et al. |
| 5,161,918 | A | 11/1992 | Hodel |
| D341,215 | S | 11/1993 | Blomquist et al. |
| 5,294,216 | A | 3/1994 | Sievert |
| D346,667 | S | 5/1994 | Blomquist et al. |
| D352,789 | S | 11/1994 | Adam |
| D378,702 | S | 4/1997 | Blomquist et al. |
| D380,560 | S | 7/1997 | Forsberg |
| D391,376 | S | 2/1998 | Strand et al. |
| 5,735,643 | A | 4/1998 | Castonguay et al. |
| D405,193 | S | 2/1999 | Scales |
| 5,865,006 | A | 2/1999 | Dawson |
| 6,024,517 | A | 2/2000 | Castonguay et al. |
| D425,628 | S | 5/2000 | Barth et al. |
| 6,073,411 | A | 6/2000 | Ciccarello |
| 6,149,352 | A | 11/2000 | MacDonald |
| D435,302 | S | 12/2000 | Blomquist et al. |
| D447,573 | S | 9/2001 | Blomquist et al. |
| 6,488,448 | B1 * | 12/2002 | Blomquist et al. ..... 405/284 |
| 6,960,048 | B2 * | 11/2005 | Blomquist et al. ..... 405/284 |
| 2006/0002769 | A1 * | 1/2006 | Blomquist et al. ..... 405/284 |

FOREIGN PATENT DOCUMENTS

| | | |
|---|---|---|
| CA | 50020 | 9/1982 |
| CA | 1182295 | 2/1985 |
| CA | 62875 | 4/1989 |
| CA | 63365 | 5/1989 |
| CA | 63366 | 5/1989 |
| CA | 67904 | 10/1991 |
| CH | 205452 | 9/1939 |
| CH | 663437 | 12/1987 |
| DE | 9015196.8 | 9/1978 |
| FR | 2343871 | 5/1976 |
| FR | 2476179 | 2/1980 |
| GB | 2127872 | 4/1984 |
| NZ | 92167 | 7/1948 |
| NZ | 215196 | 12/1989 |
| NZ | 24781 | 5/1993 |
| NZ | 25131 | 6/1994 |
| NZ | 25132 | 6/1994 |
| NZ | 25133 | 6/1994 |

OTHER PUBLICATIONS

EP Henry, "Hardscaping For All Walks Of Life", Products Catalog, 1998.

CornerStone Retaining Wall System, Project Profile, date unknown.

Mutual Materials Co., Roman Stackstone, date unknown.

Belgard, "Enhance Your Envrionment With Belgard", Mar. 1998.

LaFarge, "New Tumbled Garden Wall", date unknown.

Best Way Stone, Product Literature, 1995.

Best Way Stone, "The Europa Collection: The aged elegance of traditional hand-hewn stone", date unknown.

Versa-Lok Retaining Wall Systems, Introducing Versa-Lok Weathered, 1998.

Versa-Lok Retaining Wall Systems, "Mini: The beautiful, easy-to-install retaining wall system that is a do-it-yourselfer's dream", 1991.

Versa-Lok Retaining Wall Systems, Product Literature, 1996.

Versa-Lok Retaining Wall Systems, Design & Installation Guidelines, 1995.

Diamond Wall System, Diamond Wall System Installation Guide 1989.

Diamond Wall System, Installation Guide, date unknown.

Anchor Block/Oscar Roberts, Diamond Wall System: Tech Spec, Sep. 1988.

Keystone Retaining Wall Systems, International Compac Unit, 1992.

Besser Company, Modular Concrete Block, 1984.

* cited by examiner

RETAINING WALL SYSTEM

CROSS-REFERENCE TO RELATED APPLICATION(S)

This application is a continuation of application Ser. No. 10/230,025, filed Aug. 28, 2002, now U.S. Pat. No. 6,960,048, which is a continuation of application Ser. No. 09/479,521, filed Jan. 7, 2000, now U.S. Pat. No. 6,488,448, which is a continuation-in-part of application Ser. No. 29/112,442, filed Oct. 15, 1999, now abandoned, and a continuation-in-part of application Ser. No. 29/112,434, filed Oct. 15, 1999, now U.S. Pat. No. D435,302.

BACKGROUND OF THE INVENTION

The present invention relates to segmented retaining wall systems for soil retention or other environmental or aesthetic uses. In particular, the invention relates to retaining wall systems using masonry blocks to create modules resulting in a random appearance of the face of a retaining wall.

Segmented retaining wall systems are commonly used for residential, commercial and governmental projects. Transportation departments and the U.S. Army Corps of engineers routinely use retaining wall systems to retain soil and other structures. These systems can create straight or curved walls and can even be used along shore lines where embankment control is desired.

Segmented retaining wall systems can be comprised of poured slabs, bricks, natural stone, masonry blocks or other components. Individual units can be held together by mortar, other adhesives, gravity, pins, or other fasteners.

Uniform bricks or masonry blocks can provide a stable, durable and attractive retaining wall. However, these walls tend to have a very homogenous and uniform appearance that may not be suitable for every project. Sometimes a more unique randomized retaining wall or landscape is desired.

Natural stone can be used to provide a unique random appearance to a landscape. However, without the use of mortar or some other adhesive/sealant, natural stone retaining walls have poor soil retention properties. Additionally, Natural Stone retaining walls are expensive and cumbersome to construct. It is therefore desired to create a retaining wall system that maintains the unique random quality of a natural stone wall surface, with the structural and soil retention properties, as well as the economic efficiencies, of man-made masonry block walls.

Working with masonry blocks of different size affects the securing methods typically used during construction. A mortarless wall that uses pins to secure masonry blocks would require numerous pins of different sizes corresponding to the size of the particular masonry block. Installers have the burden of keeping track of the appropriate pins and using them accordingly. It is desirable to have a universal securing pin that could be used with different sized masonry blocks.

Depending on the requirements of the landscape, the composition of the soil, the height of a wall, or the desired aesthetic appearance of a wall, a segmented retaining wall may need to be canted or vertical. It is desirable to have masonry blocks for a mortarless segmented retaining wall that can be used to build either a canted wall or a vertical wall.

BRIEF SUMMARY OF THE INVENTION

The present invention is a retaining wall structure having a first course of side-by-side block modules and a second course of side-by-side block modules. Each block module of the first and second courses has a generally similar quadrilateral front face of a generally similar height and length. Each block module is comprised of a first row of blocks and a second row of blocks. Each of the blocks of the first row each have a length different than each of the blocks of the second row. Each block module of the second course overlies two block modules of the first course.

BRIEF DESCRIPTION OF THE DRAWINGS

The present invention will be further explained with reference to the drawing figures referenced below, wherein like structure is referred to by like numerals throughout the several views.

While the above-identified drawings set forth preferred embodiments of the present invention, other embodiments of the present invention are also contemplated, as noted in the discussion. This disclosure presents illustrative embodiments of the present invention by the way of representation and not limitation. Numerous other modifications and embodiments can be devised by those skilled in the art which fall within the scope and spirit of the principles of this invention.

DETAILED DESCRIPTION

Figure 1:
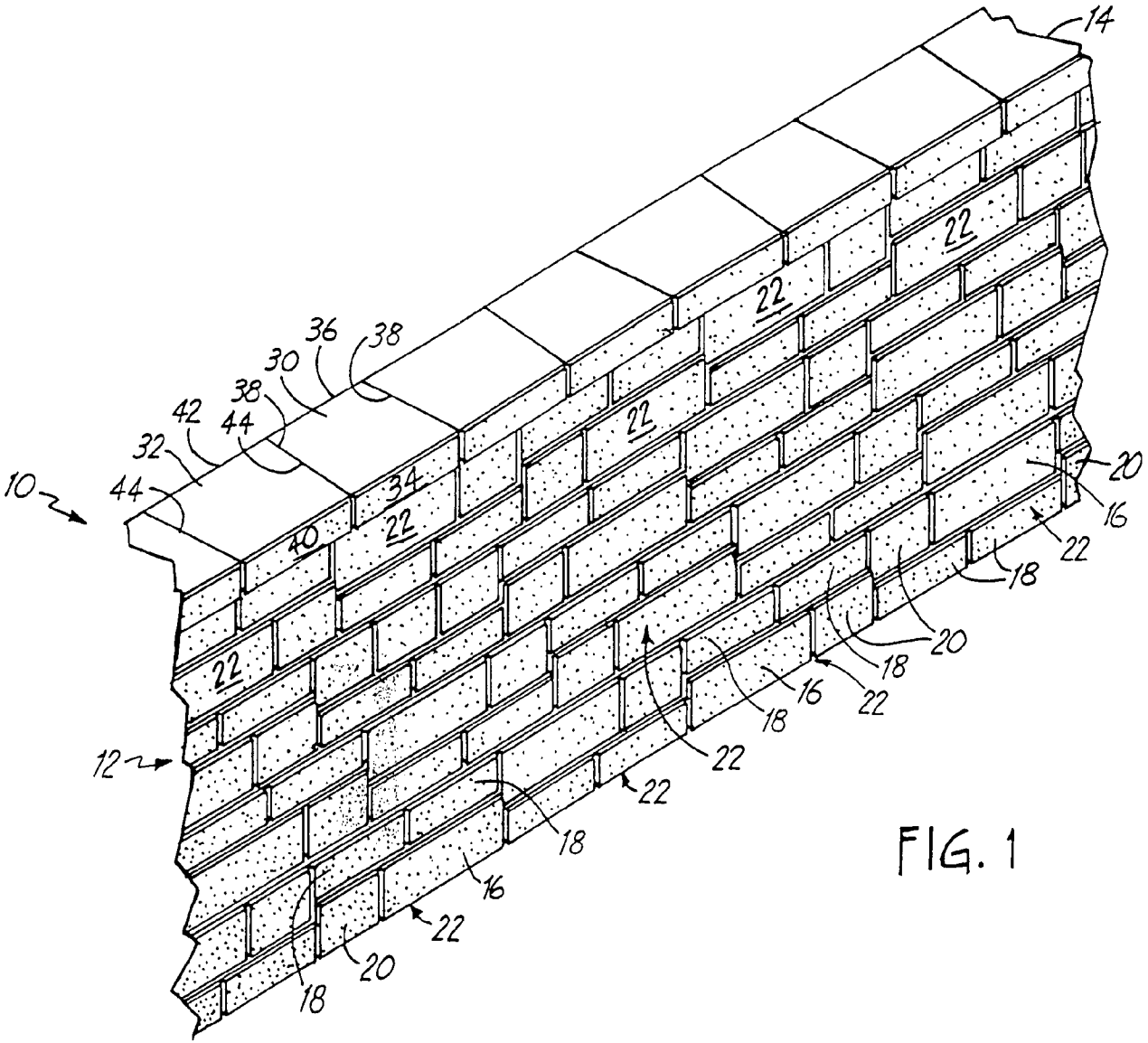
FIG. 1 is a partial perspective view of an embodiment of the modular segmented retaining wall of the present invention.
Figure 2:
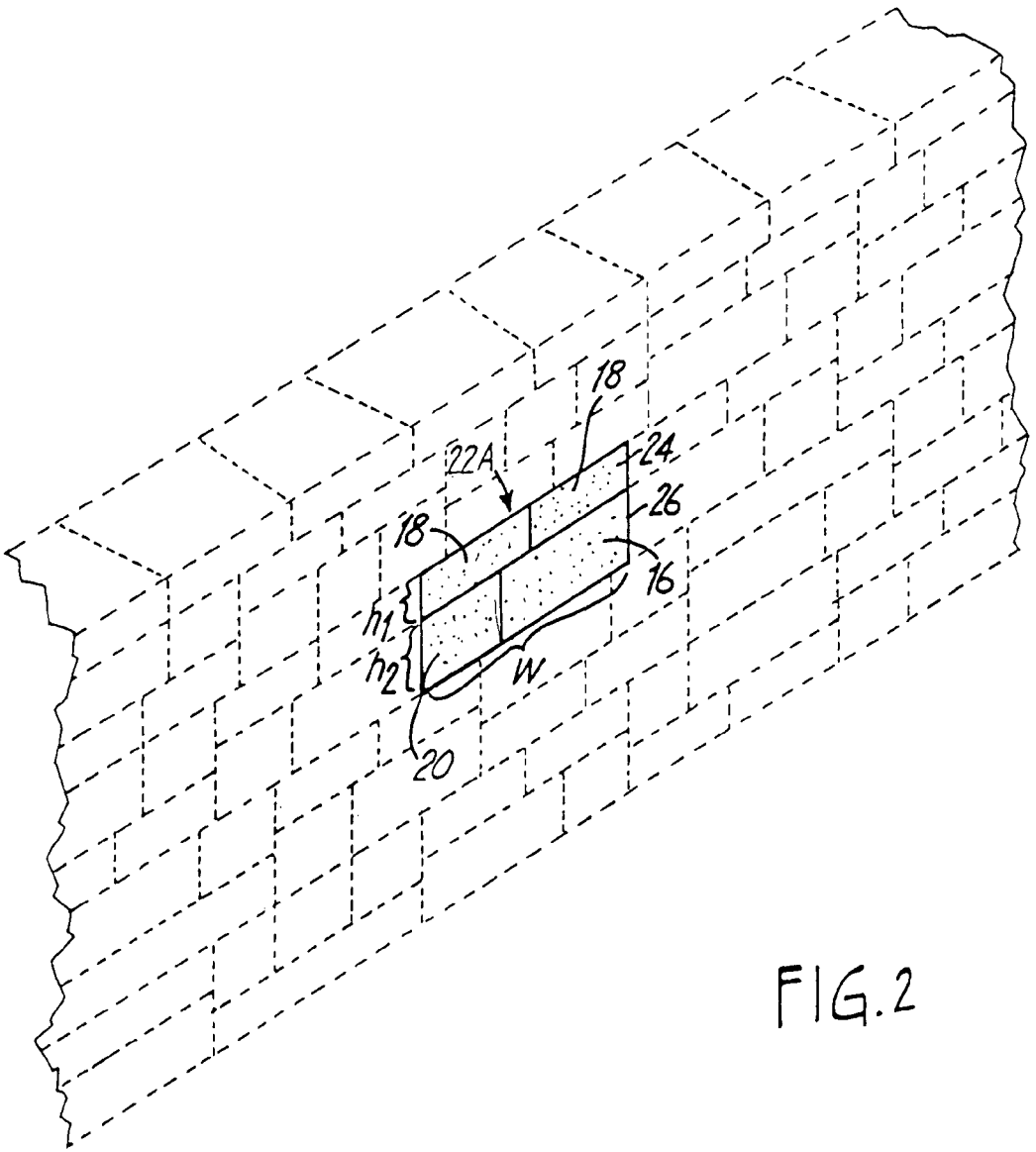
FIG. 2 is a perspective view of a first module of the present invention shown in the context of a modular segmented retaining wall.
Figure 3:
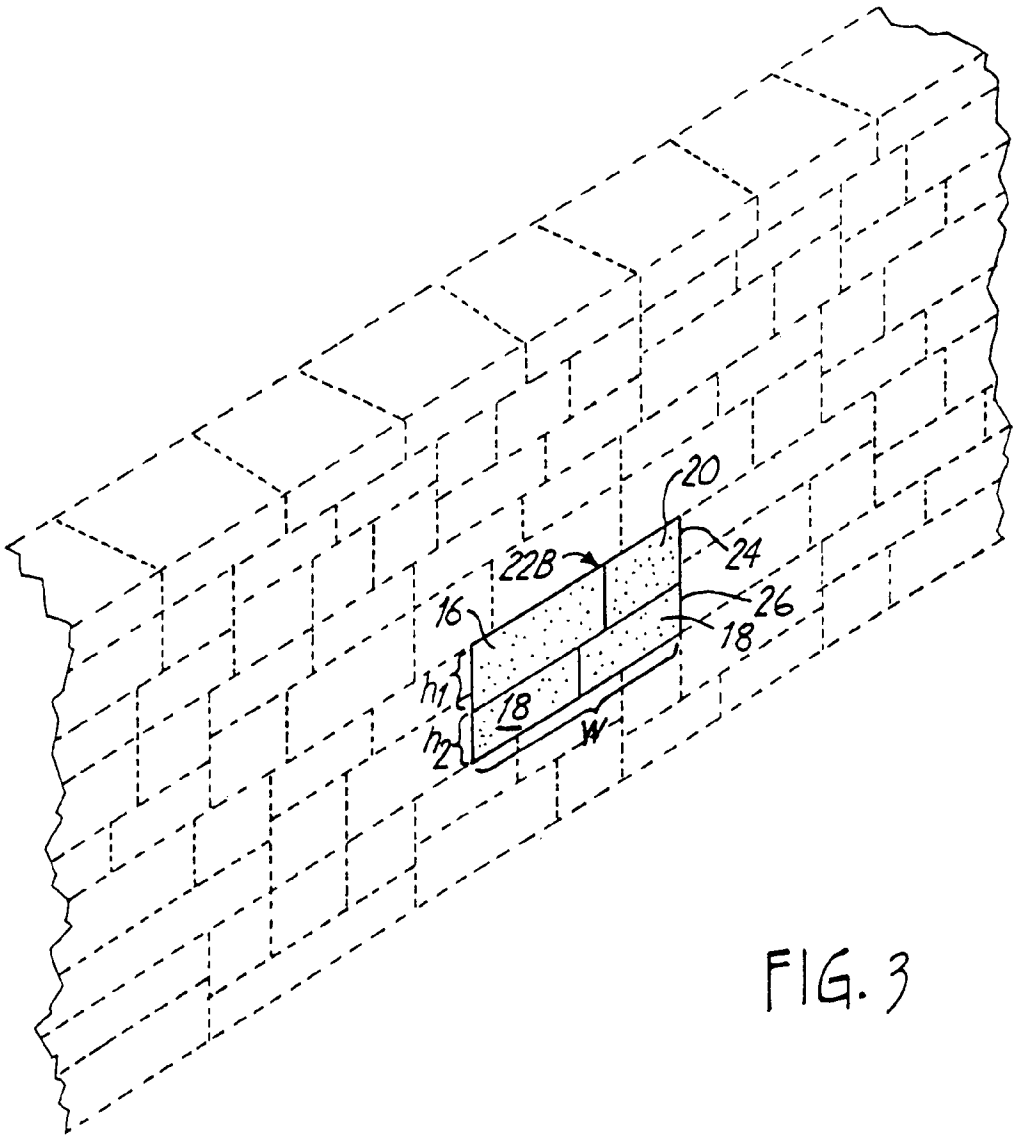
FIG. 3 is a perspective view of a second module of the present invention shown in the context of a modular segmented retaining wall.
Figure 4:
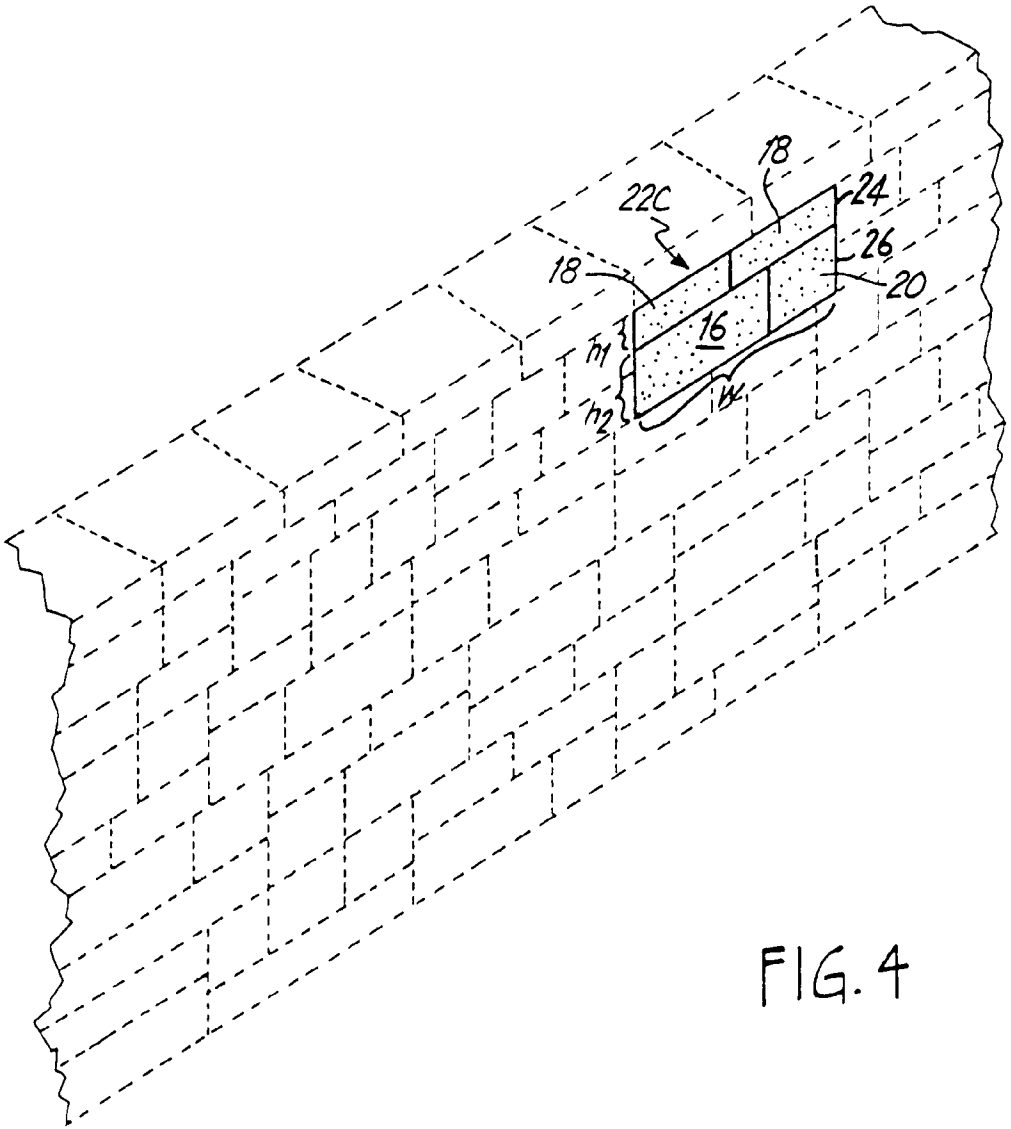
FIG. 4 is a perspective view of a third module of the present invention shown in the context of a modular segmented retaining wall.
Figure 5:
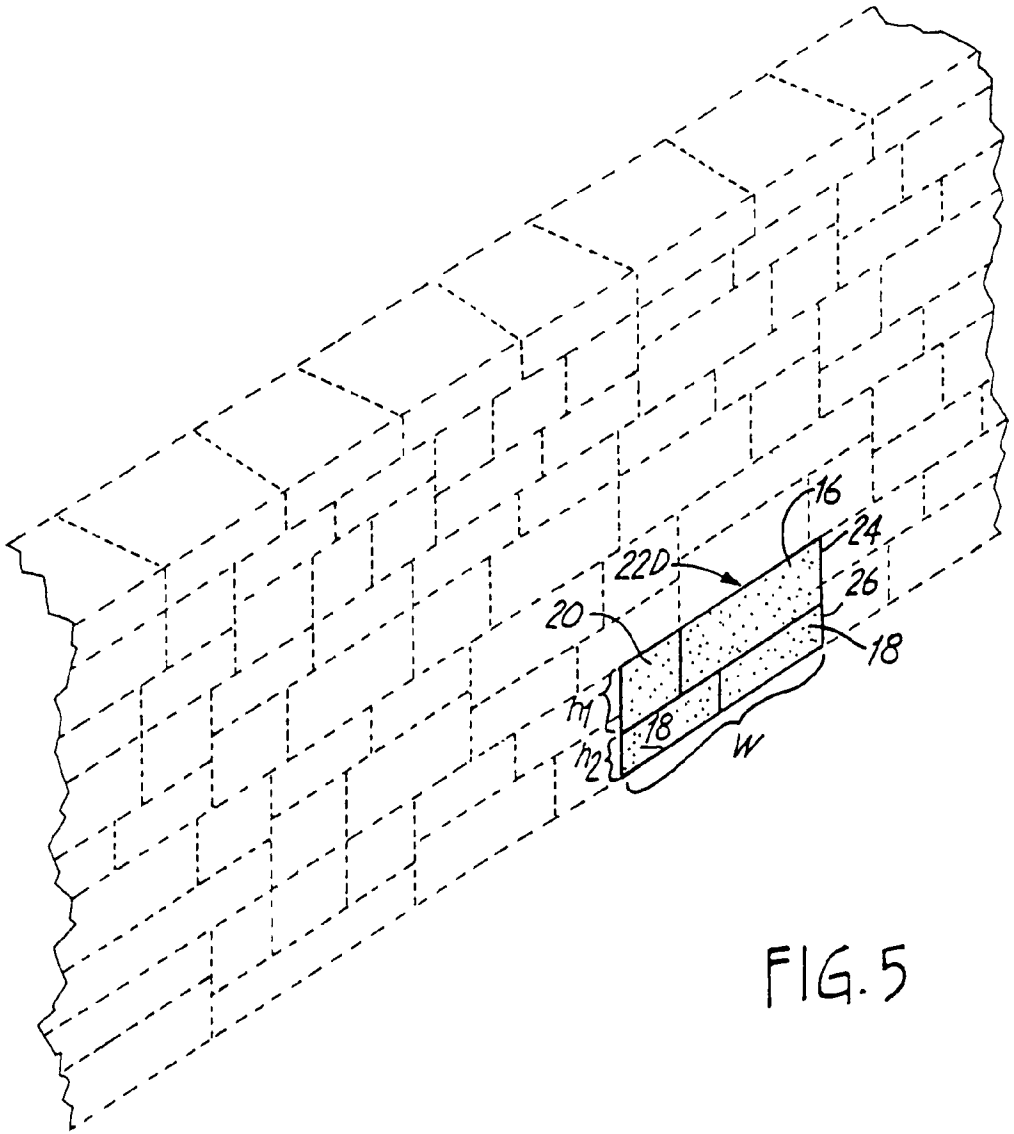
FIG. 5 is a perspective view of a fourth module of the present invention shown in the context of a modular segmented retaining wall.
Figure 6:
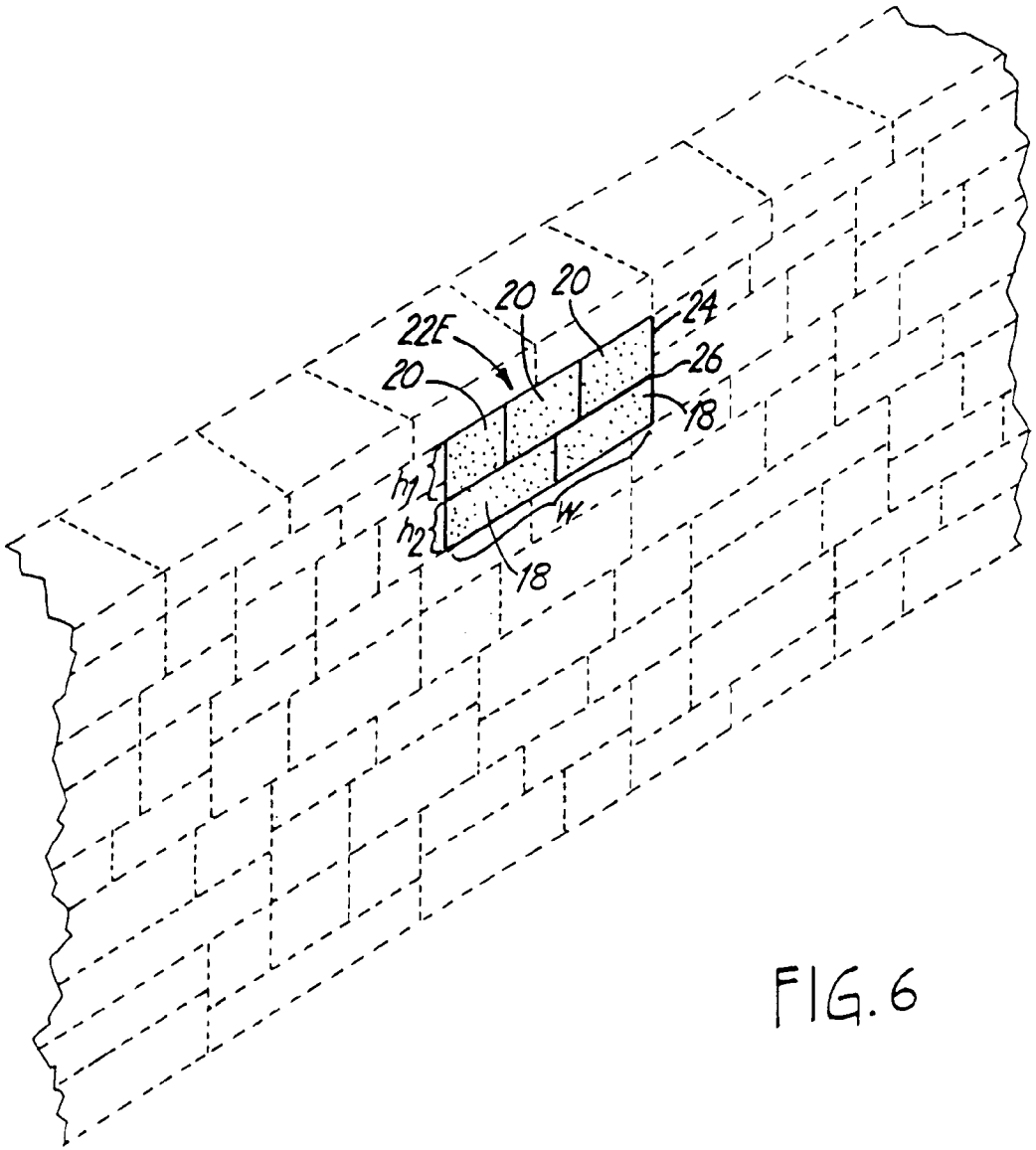
FIG. 6 is a perspective view of a fifth module of the present invention shown in the context of a modular segmented retaining wall.
Figure 7:
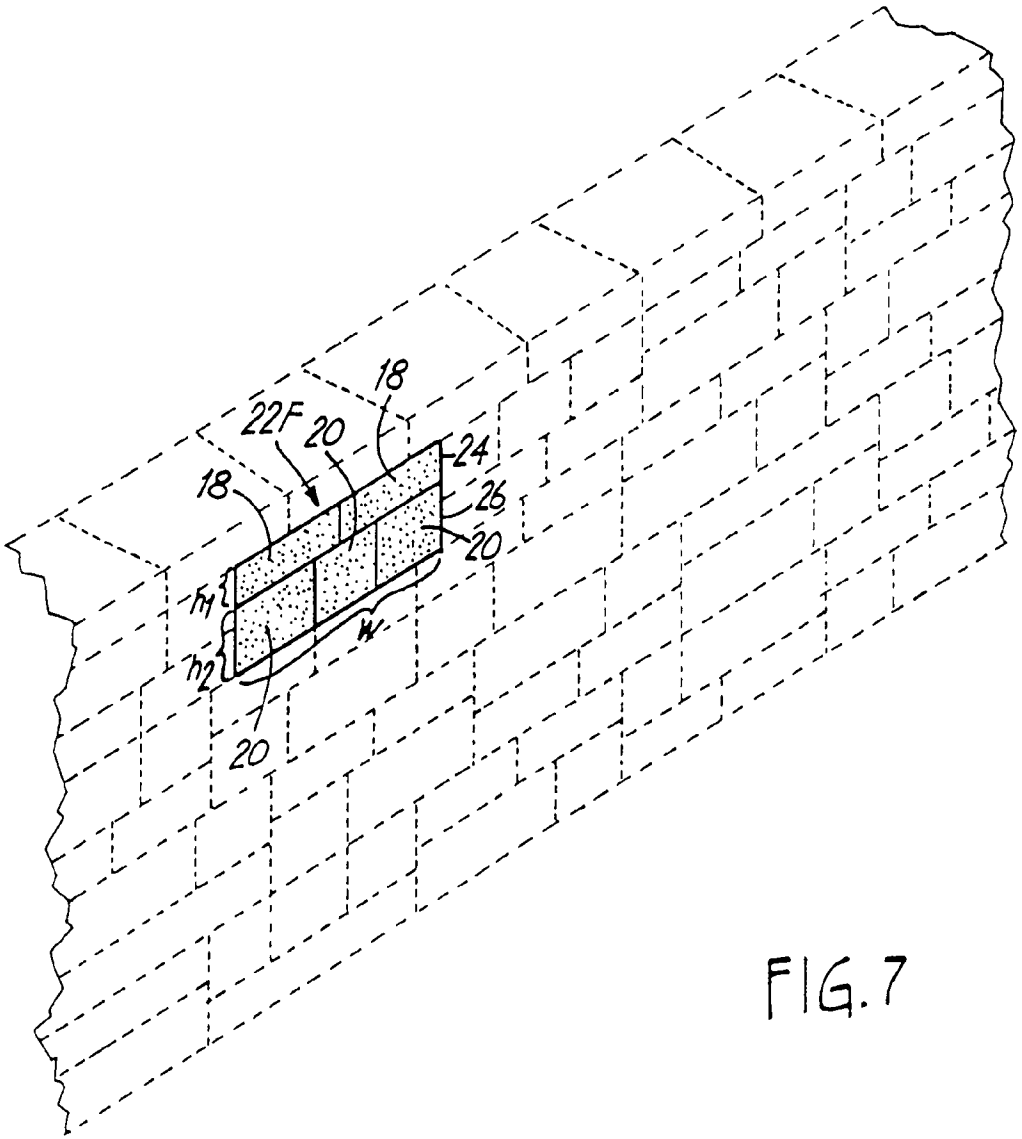
FIG. 7 is a perspective view of a sixth module of the present invention shown in the context of a modular segmented retaining wall.

FIG. 1 illustrates an embodiment of the modular retaining wall of the present invention. Retaining wall 10 includes modular wall body 12 and cap course 14. Wall body 12 and cap course 14 are formed by stacking individual masonry blocks. Retaining wall 10 can be a straight wall or can be curved with either a convex or concave curvature to follow the specific requirements of a landscape. Retaining wall 10 can be canted or nearly vertical. The modular wall body 12 provides a unique appearance to wall 10 without requiring each masonry block contained therein to be uniquely shaped or sized.

Wall body 12 is formed with masonry blocks 16, 18, and 20 (masonry blocks 16, 18, and 20 will be discussed in further detail with respect to FIGS. 8-10). Masonry blocks 16, 18, and 20 are of different dimensions and are combined to form modules 22. Modules 22 are formed by assembling various combinations of masonry blocks 16, 18, and 20, while maintaining constant overall dimensions of modules 22 and front surface area of modules 22. Modules 22 are interchangeably arranged to form modular retaining wall 10. Modules 22 are like separate larger blocks with ascending courses of modules 22 having variable canting and variable bond (i.e., variable lateral spacing of blocks from one course to the next). Arranging modules 22 interchangeably creates a segmented retaining wall bearing the non-uniform appearance of a natural stone wall.

Cap course 14 is installed on top of modules 22 forming the top course of retaining wall 10. Cap course 14 preferably includes cap stones 30 and 32. Cap stones 30 and 32 are trapezoidal in shape. Cap stone 30 includes front textured face 34, rear face 36, and sides 38. Sides 38 of cap stone 30 connect front textured face 34 and rear face 36. Front textured face 34 is wider than rear face 36, and sides 38 angle inward as sides 38 recede toward rear face 36. Cap stone 32 includes front textured face 40, rear face 42, and sides 44. As with cap stone 30, sides 44 connect faces 40, and 42. However, sides 44 angle outward as sides 44 recede toward rear face 42.

For retaining wall 10 without curves, cap stones 30 and 32 alternate so that respective front textured faces 34 and 40 form a flush continuous rim. A retaining wall 10 having a convex (outside) curve will include cap course 14 that includes only cap stones 30 so that front surfaces 34 form a curved continuous rim. A retaining wall 10 with a concave (inside) curve will include a cap course 14 having only cap stones 32, where front surfaces 40 form a curved continuous rim.

Front textured surfaces 34 and 40 have the same dimensions and surface area. Preferably, textured front surfaces 34 and 40 of cap stones 30 and 32 are 14 inches wide and 3⅝ inches high. Preferably, cap stones 30 and 32 are 12 inches deep. The width of rear face 36 of cap stone 30 is 16 inches, and the width of rear face 42 of cap stone 32 is 12 inches.

Modules

Preferably, blocks 16, 18, and 20 are arranged to create six different patterned modules 22A, 22B, 22C, 22D, 22E, and 22F. (Referred to collectively to as modules 22). FIGS. 2-7 illustrate each of the six modules 22. Each module 22 includes top course 24 and bottom course 26. Top course 24 has a first height $h_1$ and bottom course 26 has second height $h_2$. The height of each module 22 is the sum of height $h_1$ and height $h_2$. Each module 22 has a width w that is equal to the combined width of its masonry blocks. Modules 22 are arranged interchangeably during construction of retaining wall 10 because the modules 22 have roughly the same dimensions including an identical exposed front surface area ([height $h_1$+height $h_2$]×width w).

Module 22A includes two masonry blocks 18 adjacent to each other in top course 24, and includes block 16 positioned to the right of block 20 in bottom course 26. (See FIG. 2). Module 22B includes block 16 positioned to the left of block 20 in top course 24, and includes two blocks 18 in the bottom course 26. (See FIG. 3). Module 22C includes two blocks 18 in top course 24, and includes block 16 to the left of block 20 in bottom course 26. (See FIG. 4). Module 22D includes block 16 to the right of block 20 in top course 24, and two blocks 18 in bottom course 26. (See FIG. 5). Module 22E includes three blocks 20 in top course 24, and two blocks 18 in bottom course 26. (See FIG. 6). Module 22F includes two blocks 18 in top course 24, and three blocks 20 in bottom course 26. (See FIG. 7). Construction of retaining wall 10 is discussed below with respect to FIG. 12.

The Masonry Blocks

Masonry blocks 16, 18, and 20 are mortarless retaining wall blocks that are held together by gravity and pins. The primary difference between masonry blocks 16, 18, and 20 is the size and shape of the blocks. However, all masonry blocks 16, 18, and 20 can be coupled to one-another. Masonry blocks 16, 18, and 20 all receive and accommodate retaining pins, which are used to hold the blocks together. Furthermore, masonry blocks 16, 18, and 20 can be used to build a vertical wall or an angled wall. Each of masonry blocks 16, 18, and 20 will be discussed separately below.

Figure 8:
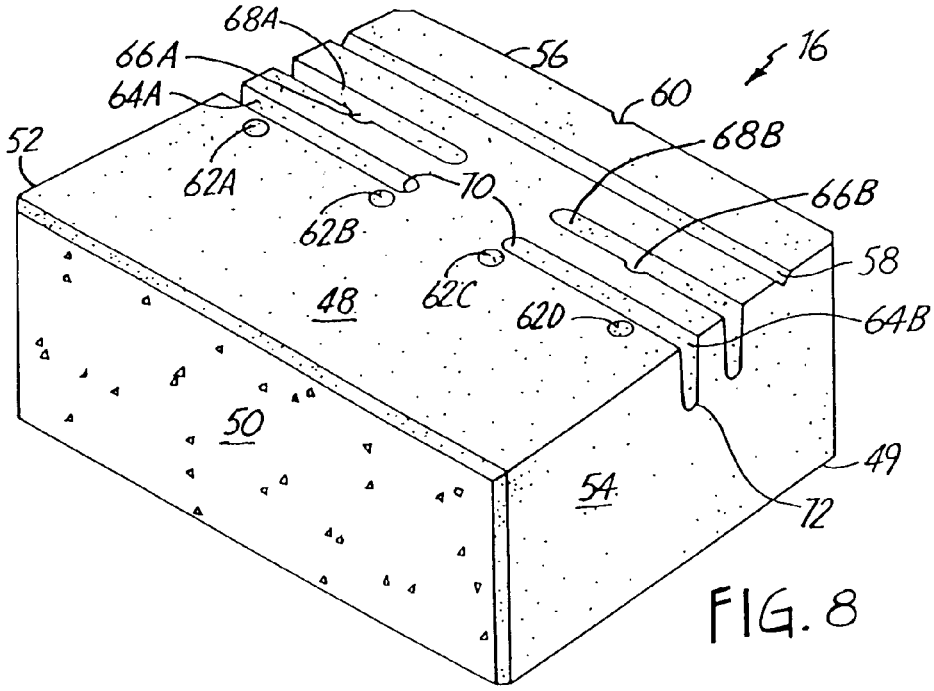
FIG. 8 is a perspective view of a first masonry block of the present invention.
Figure 8A:
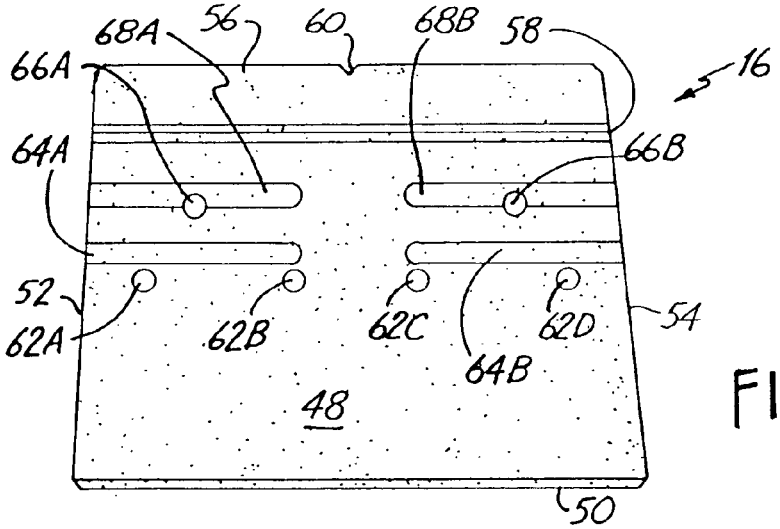
FIG. 8A is a top plan view of the first masonry block of FIG. 8.
Figure 8B:
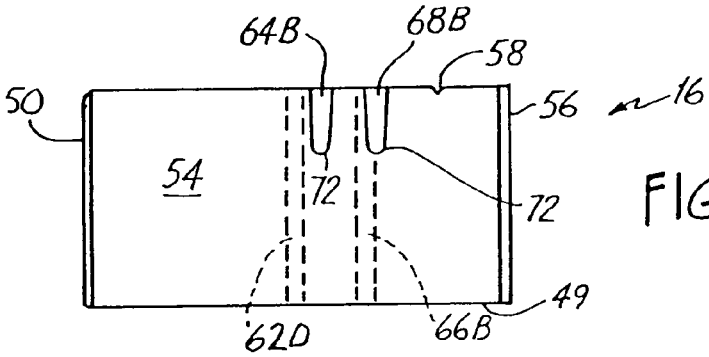
FIG. 8B is a side elevational view of the first masonry block of FIG. 8.

FIGS. 8, 8A, and 8B, show, in detail, masonry block 16. Masonry block 16 includes top surface 48, bottom surface 49, front face 50, sidewalls 52, 54, and rear face 56. As shown, the block faces have a number of slots and holes therein, including horizontal splitting groove 58, rear vertical splitting groove 60, set-back pinholes 62A, 62B, 62C, and 62D (collectively referred to as set-back pin holes 62), set-back receiving slots 64A and 64B (collectively referred to as set-back receiving slots 64), vertical pin holes 66A and 66B (collectively referred to as vertical pin holes 66), and vertical receiving slots 68A and 68B (collectively referred to as vertical receiving slots 68).

Block 16 has a trapezoidal shape where front face 50 and rear face 56 are parallel. Sidewalls 52 and 54 angle inward as sidewalls 52 and 54 recede toward rear face 56. Thus front face 50 is wider than rear face 56.

Sidewalls 52 and 54 and rear face 56 are smooth while front face 50 is textured. The textured appearance is accomplished by splitting a hardened masonry block. Masonry blocks 16 are initially manufactured "piggy back", where two blocks 16 are manufactured facing each other as one slab (not shown). A central splitting groove (not shown) along the single slab divides what will become two blocks 16. After hardening, the slab is split into two blocks 16 along the central splitting groove creating two textured surfaces 50. A masonry block can be split by a splitting device or by hand using a masonry chisel and large hammer. After scoring a desired path of the split, the unit is fractured along the scored path to create an attractive textured surface.

When it is necessary to have a textured front and back surface, such as used in a free-standing wall having exposed front and rear surfaces, horizontal splitting groove 58 is used. Horizontal splitting groove 58 extends across top surface 48 from sidewall 52 to sidewall 54. Masonry block 16 is split along horizontal splitting groove 58, removing a small rear portion and creating a textured rear surface. For installing corners of a wall, where both a front and a side surface need to be textured, vertical splitting groove 60 is used. Rear vertical splitting groove 60 extends across rear face 56 from top surface 48 to bottom surface 49. Splitting masonry block 16 along rear vertical splitting groove 50 creates a textured sidewall extending between front face 50 and rear face 56. Preferably, grooves 58 and 60 are triangular impressions into top surface 48 and rear face 56, respectively. The triangular impressions are a quarter inch deep and are half inch wide.

For constructing canted walls, set-back pinholes and set-back receiving slots are used. Set-back pin holes 62 are cylindrical openings that extend through masonry block 16 from top surface 48 to bottom surface 49. Set-back pin holes 62 allow for insertion of retaining pins to help secure succeeding courses of retaining wall 10 (retaining pins will be described below with respect to FIGS. 11-12). Masonry block 16 has four set-back pin holes 62 and two set-back receiving slots 64. Set-back pin holes 62A and 62B are positioned in front of set-back receiving slot 64A, while set-back pin holes 62C and 62D are positioned in front of set-back receiving slot 64B. The front-to-front spacing between set-back pin holes 62 and set-back receiving slots 64 determines the amount of set-back between two courses of blocks. During installation of canted retaining walls, block 16 is positioned over an underlying block so that certain of set-back pin holes 62 line up directly over set-back receiving slots of the underlying block.

Set-back receiving slots 64A and 64B are hollow channels that extend from sidewalls 52 and 54, respectively, into the body of masonry block 16. Set-back receiving slots 64 of block 16 receive retaining pins from overlying masonry blocks. Set-back receiving slots 64 are elongated to allow flexibility in the amount of variable bond and to allow masonry block 16 to receive retaining pins from masonry blocks 18 and 20. As seen in FIGS. 8 and 8B, set-back receiving slots 64 taper as they descend away from top surface 48. Each set-back receiving slot 64 further includes inner edge 70 and lower edge 72, both of which are rounded. Inner edge 70 runs vertically from top surface 48 into the block body, while lower edge 72 runs horizontally from sidewall 52 or 54 to the bottom of inner edge 70.

Preferably, set-back pin holes 62 have a diameter of ⅝ inch. Preferably, set-back receiving slots 64 have a width at top surface 48, that is equal to the diameter of set-back pinholes 62. Set-back pin hole 62B is aligned with inner edge 70 of set-back receiving slot 64A, and set-back pin hole 62C is aligned with inner edge 70 of set-back receiving slot 64B, wherein the center of each pin hole 62B and 62C is spaced laterally 1¾ inches from the center line of masonry block 16. The lateral distance separating set-back pinholes 62A and 62B is the same as the lateral distance separating set-back pinholes 62C and 62D. That distance is greater than the distance separating set-back receiving slots 64A and 64B. Preferably, set-back pin holes 62A and 62C are spaced laterally 4⅛ inches away from set-back pin holes 62B and 62D, respectively. Set-back pin holes 62 are positioned ¾ inch forward of set-back receiving slots 64.

For near-vertical wall construction, vertical pin holes 66 and vertical receiving slots 68 are used. Vertical pin holes 66 are positioned between set-back receiving slots 64 and vertical receiving slots 68. More specifically, vertical pin holes 66 are only slightly spaced forward of vertical receiving slots 68 and partially overlap them. Vertical pin holes 66 are only partially cylindrical because near top surface 48 vertical pin holes 66 extend through vertical receiving slots 68 and appear as semi-circular grooves running vertically along vertical receiving slot 68. The portion of vertical pin holes 66 that lies below vertical receiving slots 68 is cylindrical in shape and identical to set-back pin holes 62.

Preferably, set-back receiving slots 64 and vertical receiving slots 68 are 1⅞ inches deep. Vertical pinholes 66 have a ⅝ inch diameter and are spaced 4⁷⁄₁₆ inches to either side of the center line of masonry block 16. Vertical pin holes 66 partially project through vertical receiving slots 68 so that the center of vertical pin holes 66 is positioned ¼ inch forward of the center line of vertical receiving slots 68.

During installation of near-vertical retaining walls, block 16 is positioned over an underlying block so that certain of vertical pin holes 66 line up directly over vertical receiving slots of the underlying block. Some amount of set-back is provided, in the near-vertical alignment, by the offset of vertical pin holes 66 from vertical receiving slots 68. The initial set-back is provided to accommodate the natural forces and stress applied on the wall by the backfill during construction. The forces applied by the backfill push the resulting wall forward into an essentially vertical alignment. Attempting to construct a vertical wall without any initial set-back would result in a retaining wall that leans forward once completed due to the forces applied by the backfill.

Masonry block 16 is preferably made from high-strength, low-absorption concrete on standard block molding machines. Preferably, masonry block 16 is 6 inches high and 12 inches deep. Front face 50 of block 16 is 16 inches wide and rear face 56 is 14 inches wide. Masonry block 16 is resistant to damage during and after construction in all climates and provides unsurpassed durability.

Figure 9:
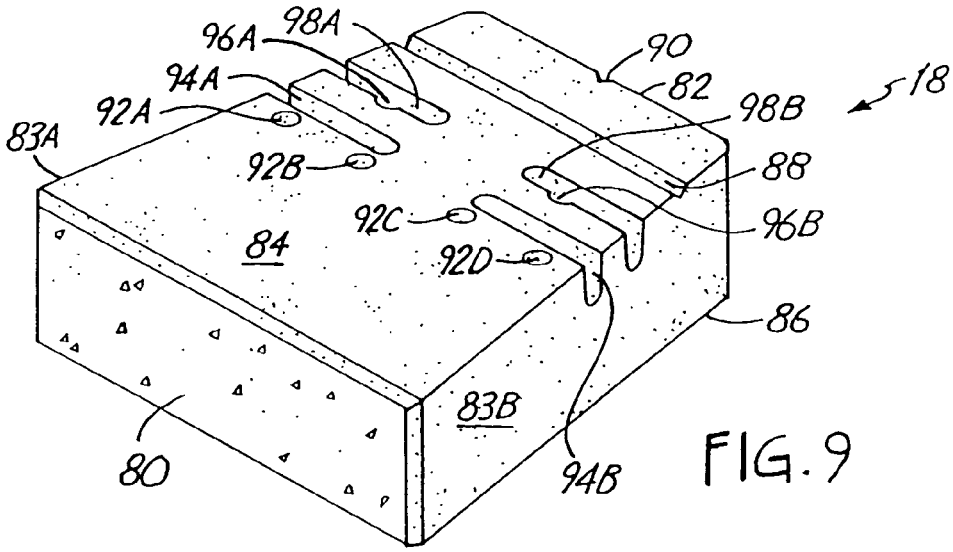
FIG. 9 is a perspective view of a second masonry block of the present invention.
Figure 9A:
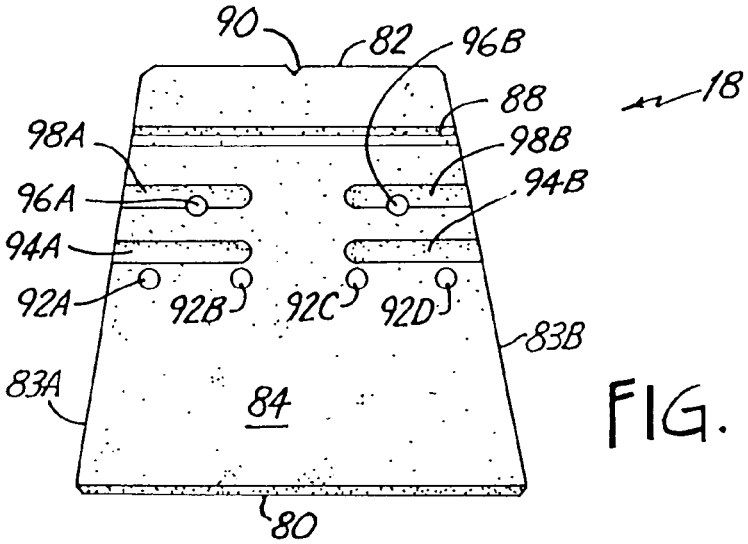
FIG. 9A is a top plan view of the second masonry block of FIG. 9.
Figure 9B:
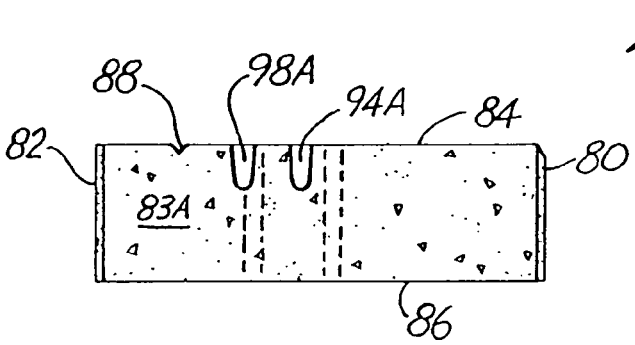
FIG. 9B is a side elevational view of the second masonry block of FIG. 9.

FIGS. 9, 9A, and 9B, show, in detail, masonry block 18. In the modular retaining wall of the present invention, masonry block 18 is used in the opposite course of masonry blocks 16 and 20 in all modules 22. But-for its shape and dimensions, masonry block 18 is identical to masonry block 16. Masonry block 18 includes front face 80, rear face 82, sidewalls 83A and 83B, top surface 84, and bottom surface 86. As shown, the block faces have a number of slots and holes therein, including horizontal splitting groove 88, rear vertical splitting groove 90, set-back pin holes 92A, 92B, 92C, and 92D (collectively referred to as set-back pin holes 92), set-back receiving slots 94A and 94B (collectively referred to as set-back receiving slots 94), vertical pin holes 96A and 96B (collectively referred to as vertical pin holes 96), and vertical receiving slots 98A and 98B (collectively referred to as vertical receiving slots 98).

As described above with respect to masonry block 16, masonry block 18 is also trapezoidal with front face 80 being wider than rear face 82, and masonry block 18 includes four set-back pin holes 92 (see set-back pin holes 62 of FIG. 8), two set-back receiving slots 94 (see set-back receiving slots 64 of FIG. 8), two vertical pin holes 96 (see vertical pin holes 66 of FIG. 8), two vertical receiving slots 98 (see vertical receiving slots 68 of FIG. 8), horizontal splitting groove 88 (see horizontal splitting groove 58 of FIG. 8), and rear vertical splitting groove 90 (see rear vertical splitting groove 60 of FIG. 8). Like masonry block 16, masonry block 18 is used to construct near-vertical or canted segmented retaining walls, and can be coupled to any of masonry blocks 16, 18, and 20. Masonry blocks 18 are manufactured in the same manner as blocks 16.

Masonry block 18 has a smaller width and height than masonry block 16. Preferably, front face 80 of masonry block 18 is 12 inches wide (compared to the 16 inch width of front face 50 of block 16) and rear face 82 is 8 inches wide (compared to the 14 inch width of rear face 56 of block 16). Block 18 is preferably 4 inches high and 12 inches deep. Masonry block 18 is preferably made from high-strength, low-absorption concrete on standard block molding machines.

Preferably, set-back pin holes 92 and vertical pin holes 96 have diameters of ⅝ inch. As with masonry block 16, the two inner most set-back pin holes 92B and 92C are aligned with an inner edge of their respective receiving slot 94A and 94B, wherein the center of each pinhole 92B and 92C is spaced laterally 1 19/16 inches from the center line of masonry block 18. Also as with masonry block 16, the lateral distance separating set-back pin holes 92A and 92B is the same as the lateral distance separating set-back pinholes 92C and 92D. That lateral distance is 2⅜ inches. Set-back pin holes 92 are positioned ¾ inch forward of set-back receiving slots 94.

Preferably, set-back receiving slots 94 and vertical receiving slots 98 are 1¼ inches deep. Vertical pin holes 96 are spaced 2 11/16 inches to either side of the center line of masonry block 18. Vertical pin holes 96 partially project through vertical receiving slots 98 so that the center of vertical pin holes 96 is positioned ¼ inch forward of the center line of vertical receiving slots 98.

Figure 10:
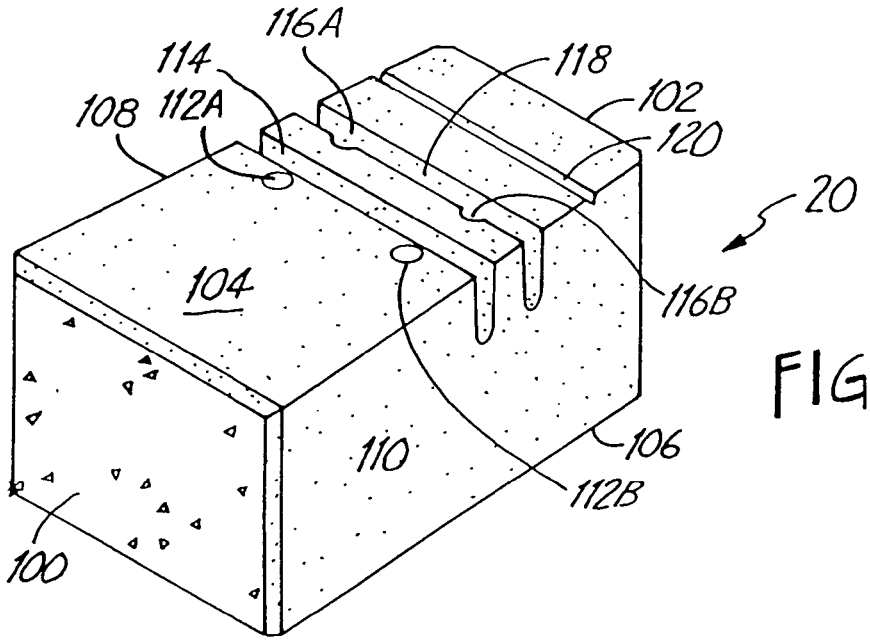
FIG. 10 is a perspective view of a third masonry block of the present invention.
Figure 10A:
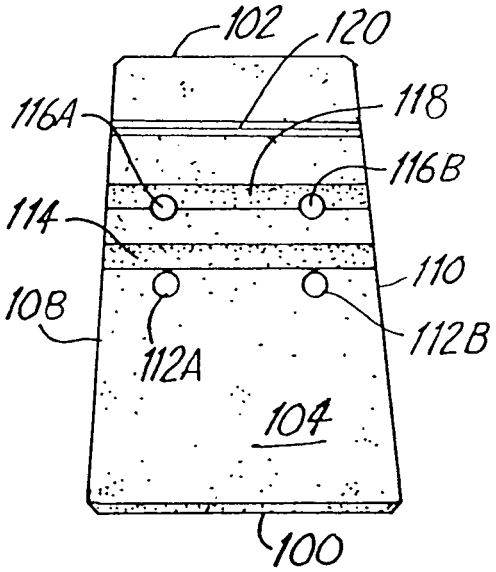
FIG. 10A is a top plan view of the third masonry block of FIG. 10.
Figure 10B:
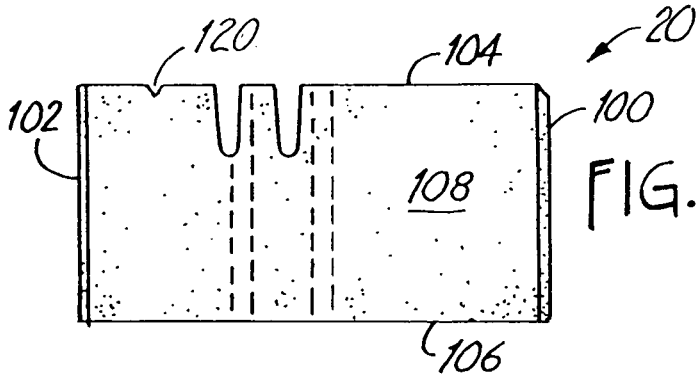
FIG. 10B is a side elevational view of the third masonry block of FIG. 10.

FIGS. 10, 10A, and 10B show, in detail, masonry block 20. Masonry block 20 is the smallest of masonry blocks 16, 18 and 20 of the present invention, and block 20 resembles (in dimension) a masonry block 16 that has been split in half along rear vertical splitting groove 60. Masonry block 20 includes front face 100, rear face 102, top surface 104, bottom surface 106, and sidewalls 108 and 110. As shown, the block faces have a number of slots and holes therein, including set-back pin holes 112A and 112B (collectively referred to as set-back pin holes 112), set-back receiving slot 114, vertical pin holes 116A and 116B (collectively referred to as vertical pin holes 116), vertical receiving slot 118, and horizontal splitting groove 120.

Masonry block 20 has the same height as masonry block 16 and is used in the same course of modules 22A, 22B, 22C, and 22D as masonry block 16. The width of masonry block 20 combined with the width of masonry block 16 equals twice the width of masonry block 18. The width of three masonry blocks 20 also equals twice the width of masonry block 18.

As with masonry blocks 16 and 18, masonry block 20 is also trapezoidal in shape and has a textured front surface (front face 100). To create a textured rear surface, masonry block 20 is split along horizontal splitting groove 120. Unlike masonry blocks 16 and 18, masonry block 20 only has two set-back pin holes 102 as opposed to four set-back pin holes in masonry blocks 16 and 18. To maintain a consistent canting of segmented retaining wall 10, the amount of the set-back is kept constant among all three masonry blocks 16, 18 and 20. Thus, set-back pin holes 112 of masonry block 20 are ¾ inch forward of set-back receiving slot 114. Preferably, set-back pin holes 112 have the same dimensions as set-back pin holes 62 of masonry block 16 (FIG. 8) and set-back pin holes 92 of masonry block 18 (FIG. 9). Preferably, set-back pin hole 112A is positioned 3 13/16 inches from set-back pin hole 112B.

Set-back receiving slot 114 of masonry block 20 is an elongated channel that extends across top surface 104 from sidewall 108 to sidewall 110 and partially down into the body of masonry block 20. During installation, set-back receiving slot 114 rests below a set-back pin hole of the block above and receives a retaining pin that is placed into the above set-back pin hole. Assembly of the modular segmented retaining wall is described in more detail below. Set-back receiving slot 114 and vertical receiving slot 118 have the same depth as receiving slots 94 and 98 of masonry block 18 (FIG. 8). Preferably, set-back receiving slot 114 and vertical receiving slot 118 are 1¼ inches deep.

Vertical pin holes 116 are identical to vertical pin holes 66 of masonry block 16 (FIG. 8). Vertical receiving slot 118 is similar to receiving slots 68A and 68B of block 16 except that it is a single channel extending from sidewall 108 to sidewall 110 across top surface 104. Vertical pin holes 116 are horizontally aligned with set-back pin holes 112. Vertical pin holes 116 partially project through vertical receiving slot 118 so that the center of vertical pin holes 116 is positioned ¼ inch forward of the center line of vertical receiving slot 118. Masonry block 20 is preferably made from high-strength, low-absorption concrete on standard block molding machines. Preferably, masonry block 20 is 6 inches high and its front face 100 is 8 inches wide.

In another embodiment, modular retaining wall 10 uses three types of "weathered" masonry blocks. Weathered masonry blocks are simply masonry blocks 16, 18, and 20, as described above, which have been tumbled in block tumbling equipment. The tumbling process strips away corners, edges and the finished look of masonry blocks 16, 18, and 20. Weathered versions of masonry blocks 16, 18, and 20 look more like natural stone, and a wall constructed of weathered masonry blocks resembles a wall of random sized natural stone.

Universal Retaining Pin

Figure 11A:
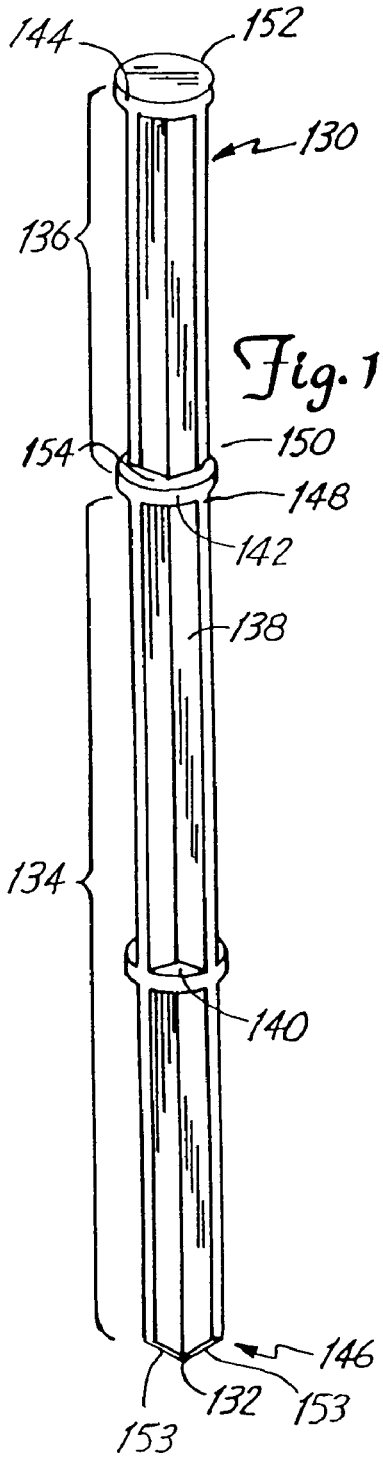
FIG. 11A is a perspective view of an embodiment of a retaining wall pin of the present invention.
Figure 11B:
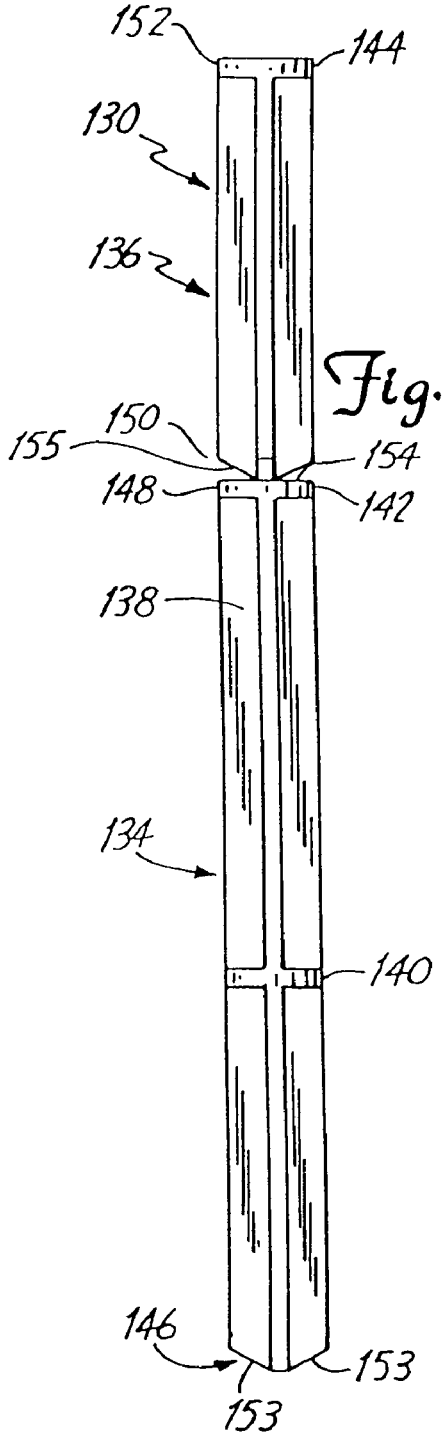
FIG. 11B is a front elevational view of the retaining wall pin of FIG. 11A.
Figure 11C:
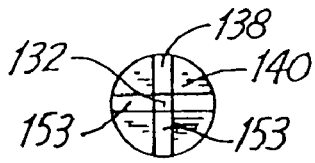
FIG. 11C is a bottom plan view of the retaining wall pin of FIG. 11A.

FIGS. 11A, 11B, and 11C illustrate the retaining pin of the present invention. Universal retaining pin 130 includes core member 132, lower section 134, upper section 136, flanges 138 and ribs 140, 142 and 144. Lower section 134 further includes distal end 146 and proximal end 148, and upper section 136 further includes distal end 150 and proximal end 152.

Core member 132 of pin 130 extends from distal end 146 of lower section 134 to proximal end 152 of upper section 136 along the central axis of pin 130. Core member 132 has a square cross section and forms the base of pin 130. Flanges 138 extend radially from core member 132 and extend along the entire length of pin 130 from distal end 146 of lower section 134 to proximal end 152 of upper section 136. Flanges 138 are integrally formed with core member 132. Preferably, there are four flanges 138, extending radially from core member 132 at right angles with respect to one another. At distal end 146 of lower section 134, ends 153 of flanges 138 taper upwardly from core member 132.

At distal end 150 of upper section 136, each flange 138 includes notch 154 so that end 155 of each flange 138 tapers upwardly from core member 132. Notches 154 allow upper section 136 to be sheared off from pin 130 leaving only lower section 134. Preferably, flanges 138 project approximately ¼ inch from core member 132.

Ribs 140, 142 and 144 are disc shaped members extending from and encompassing core member 132, as well as mating with flanges 138. Ribs 140, 142 and 144 are integrally formed with core member 132 and flanges 138 and are aligned perpendicular to core member 132 and flanges 138. Core member 132 and flanges 138 are co-axial elongated members, whose shared axis runs through the center of disk shaped ribs 140, 142, and 144. Ribs 140, 142 and 144 provide stiffness to pin 130 and help counteract shear forces exerted on pin 130 by the masonry blocks.

Universal retaining pin 130 is used to secure masonry blocks in succeeding courses of segmented retaining wall 10 of the present invention. Pin 130 also helps provide consistent alignment of masonry blocks. During installation, pin 130 is inserted into a pin hole of a first masonry block. Pin 130 drops through the first block and into an underlying block. A section of pin 130 is positioned within the underlying masonry block and another section remains in the first block.

For ease of installation, pin 130 is long enough to extend from the bottom of the receiving slot of the underlying block to nearly the top surface of the block above. However, pin 130 cannot protrude above the top surface of the upper block, where it was inserted. If pin 130 is too long, it interferes with installation of additional courses of retaining wall 10. Because the present invention uses masonry blocks of varying heights, universal retaining pin 130 has an adjustable length. When universal retaining pin 130 is inserted into masonry block 18, which has a smaller height than masonry blocks 16 and 20, upper section 136 of pin 130 is removed, shortening the length of pin 130 so that it will not protrude through top surface of masonry block 18.

Preferably, universal retaining pin 130 is a non-corrosive, nylon/fiberglass composite. Ribs 140, 142 and 144 are ½ inch in diameter. Rib 140 is spaced 2⅛ inches from distal end 146 of lower section 134. Rib 142 is positioned at proximal end 148 of lower section 134, and rib 144 is located at proximal end 152 of upper section 136. Pin 130 is 6¾ inches long, with lower section 134 being 4⅝ inches long and upper section 136 being 2⅛ inches long.

Assembly of the Modular Wall

Figure 12:
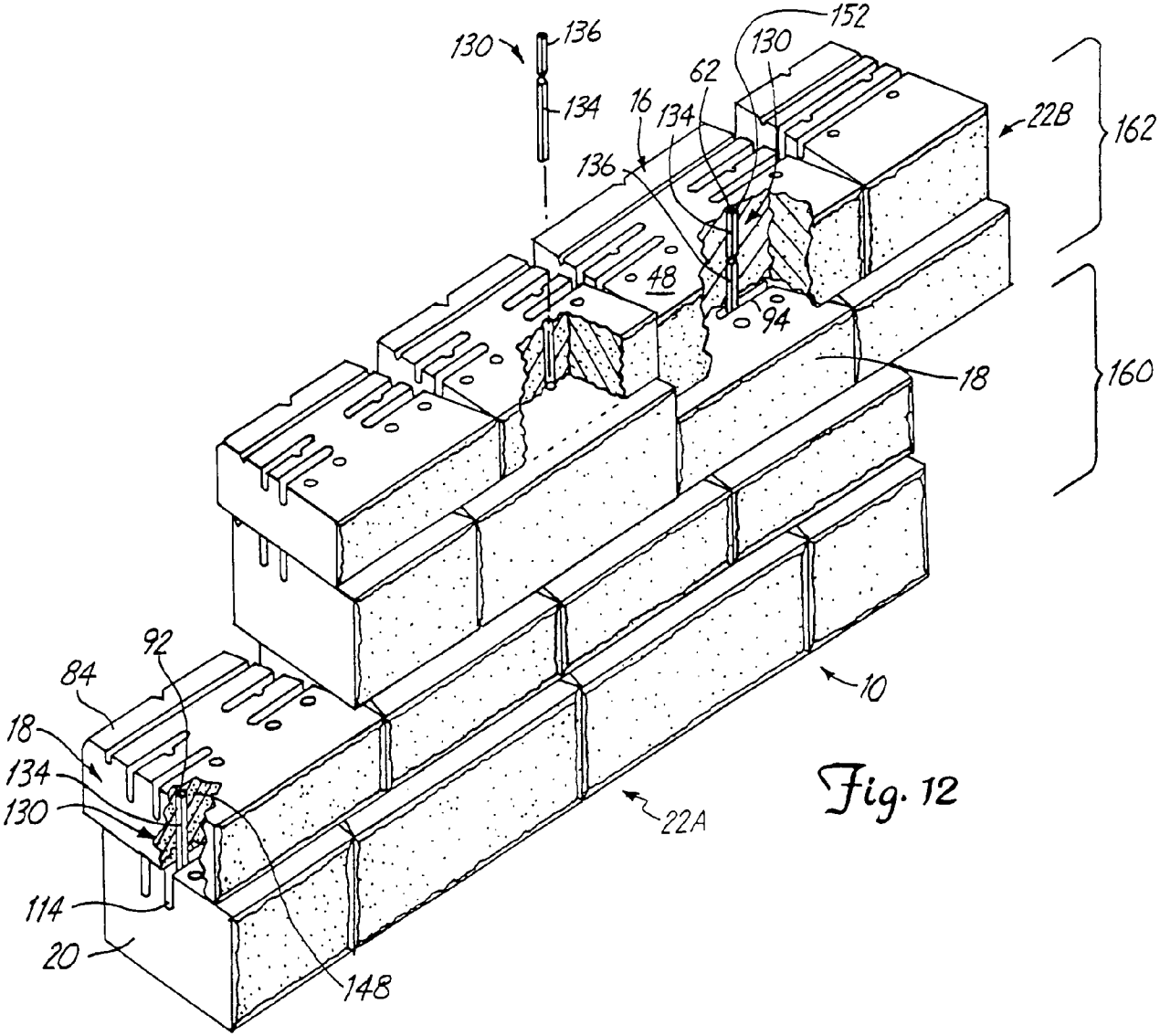
FIG. 12 is a perspective view of a portion of the modular segmented retaining wall of FIG. 1 with parts of the wall removed to illustrate its construction.

FIG. 12 is a perspective view of a portion of segmented retaining wall 10 with parts of the wall removed to illustrate its construction. Retaining wall 10 is built by stacking masonry blocks and using pins to secure the masonry blocks in place. Initially, an installer conducts standard landscape preparation for construction of a segmented retaining wall including excavating (not shown), preparing a leveling pad (not shown), and placing a base course (not shown). The base course (not shown) typically consists of uniform blocks laid to form a level, smooth base course. Then, the installer begins construction of the modular wall on top of the base course.

Retaining wall 10 is constructed one module at a time. Modules are constructed along a row creating a modular row. After a first modular row is completed, the next modular row is laid on top of the first row, one module at a time.

To construct each module, an installer first positions a bottom course of that module, which contains either two masonry blocks 18, three masonry blocks 20, or a combination of one masonry block 16 and one masonry block 20. Next, the installer completes that module by positioning a top course of blocks over the bottom course. The top course includes masonry blocks that are aligned corresponding to one of modules 22A-22F. (See FIGS. 2-7). Preferably, masonry blocks of bottom course are secured to blocks of the base course with pins 130.

After constructing one module, an adjacent module is constructed in the same manner starting with its bottom course. Adjacent modules are positioned along the length of wall 10 without being interconnected, forming a first modular course 160 of wall 10. (See FIG. 12). First modular course 160 has one uniform height along the length of wall 10, although within first modular course 160 the top courses and the bottom courses of the individual modules may vary in height.

An installer does not need to predetermine the layout of modules 22A-22F within the modular courses. All modules 22 have the same external dimensions, and for the purpose of constructing modular wall 10, are interchangeable. Thus, the installer can simply decide in the field (at the time of wall installation) which module 22A-22F will be built adjacent the previous module 22.

Preferably, second modular course 162 (see FIG. 12) is installed over first modular course 160 with a variable bond. With a variable bond, modules 22 of second modular course 162 do not need to be placed either exactly over or exactly half way over underlying modules 22 of first modular course 160. Modules 22 of second modular course 162 are horizontally offset from underlying modules 22, and each module 22 of the second modular course 162 overlaps two underlying modules 22. Thus, masonry blocks from bottom course 26 of a module 22 in second modular course 162 are secured with pins 130 to underlying masonry blocks from top course 24 from two adjacent modules 22 in first modular course 160.

Second modular course 162 is installed in the same manner as the first. Each module 22 is installed over first modular course 160, starting with its bottom course 26 followed by its top course 24. Adjacent modules 22 are installed along the length of wall 10 forming second modular course 162. Additional modular courses (not shown in FIG. 12, but see FIG. 1) are constructed in the same fashion. The resultant modular retaining wall 10 has the appearance of a random pattern stone wall, typical of natural stone. In certain conditions, depending on wall height and properties of the soil, a wall may need geosynthetic soil reinforcement for additional stability and reinforcement. Such soil reinforcement techniques are well known in the art.

Preferably, two retaining pins 130 are used to secure each masonry block to underlying masonry blocks. Preferably, pins 130 are placed in the two outer most pin holes of each block (e.g., pin holes 62A and 62D of block 16, pin holes 92A and 92D of block 18, and pin holes 112A and 112B of block 20). If one of the outside pin holes does not align with an underlying receiving slot, then the next closest pin hole is used.

More specifically, the unique designs of masonry blocks 16, 18, and 20 and universal pins 130 provide greater convenience for construction of the modular retaining wall of the present invention. The masonry blocks of top course 24 of a module 22 are positioned over underlying masonry blocks so that pinholes of the above blocks align with the appropriate receiving slots (depending on the desired amount of canting of the retaining wall) of the underlying blocks. Universal pins 130 are inserted into pinholes and drop through the pin holes and into receiving slots of the underlying masonry blocks. If pin 130 stops upon reaching the top surface of the underlying masonry block, then the overlying block must be slightly readjusted to position the pin hole directly over the underlying receiving slot, at which point pin 130 will drop into the receiving slot. Retaining pins 130 are pressed firmly into pinholes to assure that they are fully seated in the receiving slot of the underlying masonry blocks.

Retaining pin 130 has an adjustable length because it is used to secure blocks of different heights. During installation, a fully seated pin must extend to near the top of the pin hole without protruding from it, to enable the installer to ascertain whether the pin is properly inserted into a receiving slot. A pin that is too long will protrude from the block surface and interfere with the installation of the next course, while a pin that is too short will drop into a pin hole and "disappear" into the block without indicating whether it entered the underlying receiving slot. A properly sized pin will disappear into the pin hole only when properly fully seated. If the pin is not seated into an underlying receiving slot, the properly sized pin protrudes from the top of the pin hole to alert the installer.

The adjustable length of universal pin 130 allows an installer to use only one style of retaining pin while working with masonry blocks of differing heights. With respect to masonry blocks 16 and 20, which have a larger height than masonry block 18, the entire universal pin 130 is used. However, with respect to masonry block 18 only lower section 134 of universal pin 130 is used. When universal pin 130 is used to secure masonry block 18, the entire pin 130 is inserted into one of the pin holes 92 or 96, and once fully seated with its distal end 146 in a receiving slot of the below block, a shear force is applied to upper section 136 of pin 130. A hammer or other instrument (not shown) can be used to apply the shear force and to break off upper section 136 of pin 130.

For example, in FIG. 12, a module 22A is shown (the lower left-most module) with a portion of masonry block 18 removed. The removed portion of masonry block 18 reveals lower section 134 of universal pin 130 extending through set-back pin hole 92 of block 18 and seated in set-back receiving slot 114 of the underlying masonry block 20. Proximal end 148 of lower section 134 is positioned near top surface 84 of masonry block 18 and does not extend above the plane defined by top surface 84. During installation, upper section 136 of universal pin 130 was removed, leaving only lower section 134.

However, in a module 22B in FIG. 12 (the upper right-most module), masonry block 16 is shown with a portion thereof removed, exposing an inserted pin 130 including lower section 134 and upper section 136. The removed portion of masonry block 16 reveals that both sections 134 and 136 of the universal pin 130 extend through set-back pin hole 62 of block 16 and that lower section 136 is seated in set-back receiving slot 94 of the underlying masonry block 18. Proximal end 152 of upper section 136 is positioned near top surface 48 of masonry block 16 and does not extend above the plane defined by top surface 48. Masonry block 16 has a greater height than masonry block 18, so the entire length of universal pin 130 is necessary for its proper and convenient installation.

Variable Canting of the Modular Wall

Figure 13:
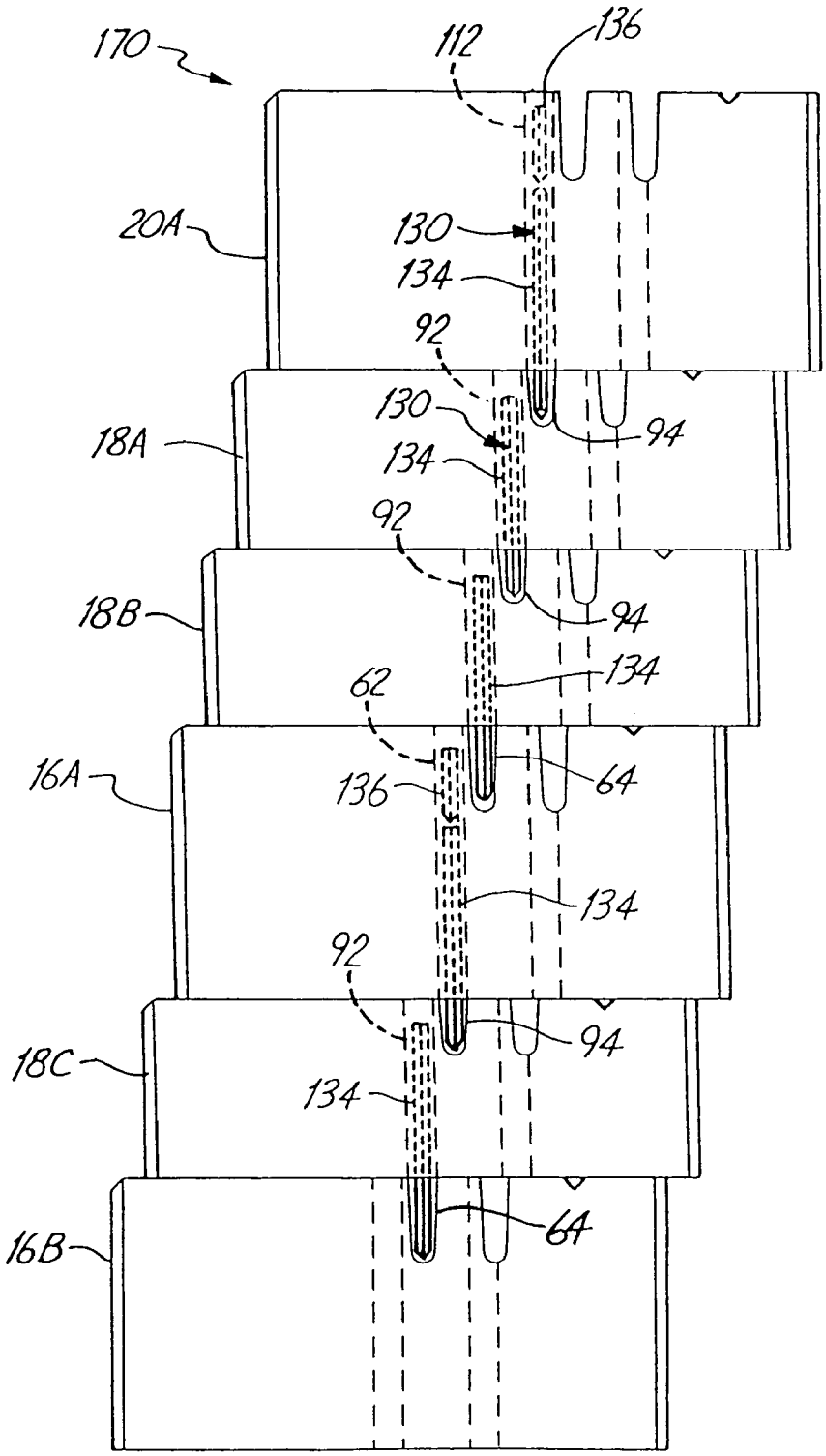
FIG. 13 is a side elevational view of an embodiment of a canted modular segmented retaining wall of the present invention.
Figure 14:
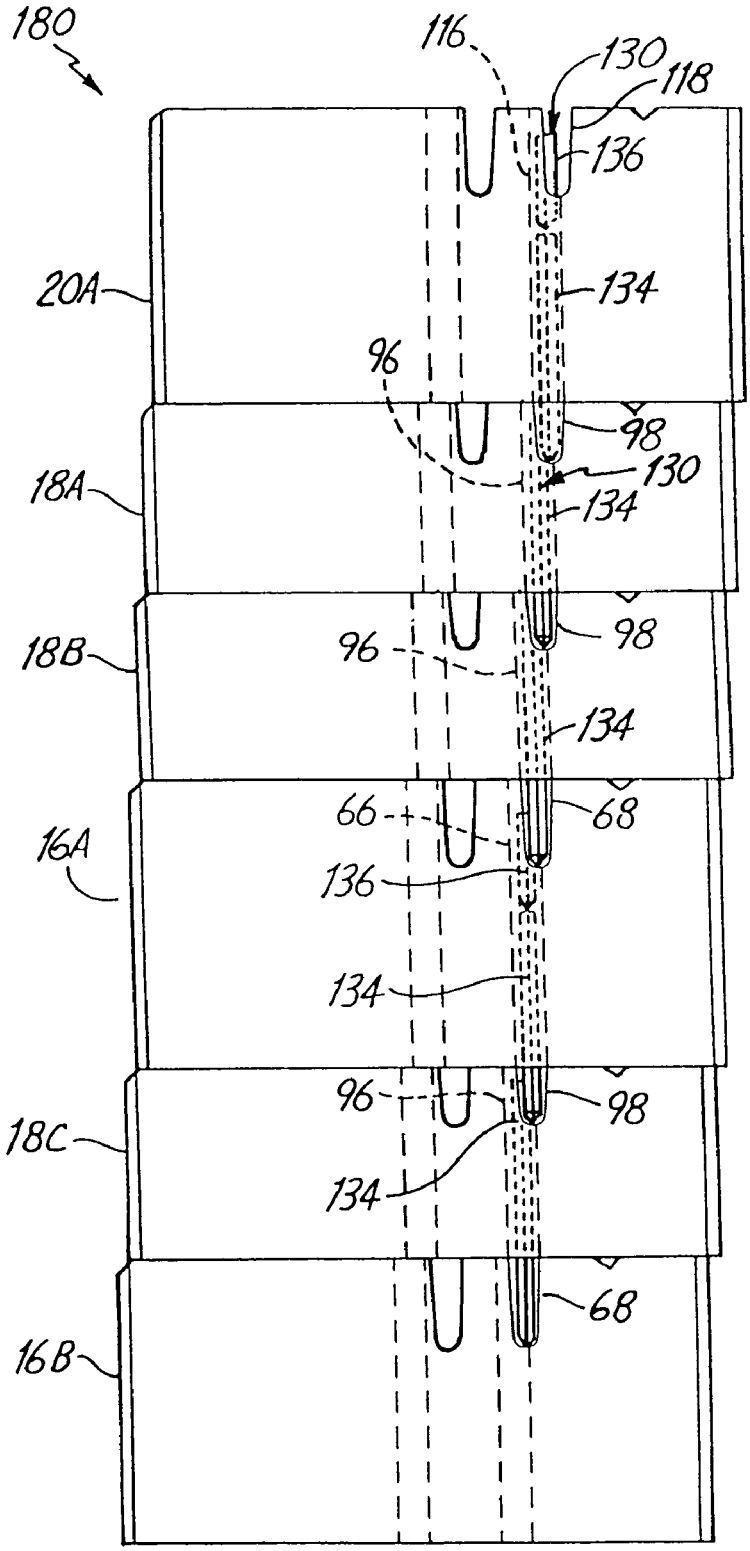
FIG. 14 is a side elevational view of an embodiment of a nearly vertical modular segmented retaining wall of the present invention.

As described above, masonry blocks of retaining wall 10 can be used to build canted walls or nearly vertical walls. FIGS. 13 and 14 illustrate this unique feature of the present invention. For canted walls, masonry blocks of the present invention are positioned so that their respective set-back pin holes are aligned over the set-back receiving slots of the underlying blocks. The amount of set-back is determined by the distance from the set-back pin hole to the set-back receiving slot. For near-vertical alignment, masonry blocks of the present invention are positioned so that their respective vertical pin holes are aligned over the vertical receiving slots of the underlying blocks. Vertical pin holes are slightly offset from vertical receiving slots to allow for a slight initial canting. However, once backfill is applied during construction, pressure from the backfill pushes the masonry blocks forward, and the resulting wall is nearly vertical.

FIG. 13 illustrates a side view of a canted retaining wall 170 having a preferred set-back alignment. FIG. 14 illustrates a side view of a near-vertical retaining wall 180 constructed with the same masonry blocks used in retaining wall 170 of FIG. 13 (the same blocks are used in the two walls 170 and 180 to best illustrate this unique variable canting feature of the masonry blocks of the present invention). For simplicity, retaining walls 170 and 180 of FIGS. 13 and 14, respectively, are shown with only six courses of blocks and without a cap stone.

Canted retaining wall 170 includes masonry block 20A secured over masonry block 18A. Masonry block 18A is secured over masonry block 18B. Masonry block 18B is secured over masonry block 16A. Masonry block 16A is secured over masonry block 18C. Masonry block 18C is secured over masonry block 16B. Near-vertical retaining wall 180 of FIG. 14 is constructed from the same combination of masonry blocks 20A, 18A, 18B, 16A, 18C, and 16B. Masonry block 20A refers to like-shaped masonry block 20 from FIGS. 10, 10A and 10B. Masonry blocks 18A, 18B, and 18C are like-shaped masonry blocks 18 from FIGS. 9, 9A and 9B. Masonry blocks 16A and 16B are like-shaped masonry blocks 16 from FIGS. 8, 8A and 8B.

As shown in FIG. 13, set-back pin hole 112 of block 20A is aligned with underlying set-back receiving slot 94 of block 18A, and universal pin 130 is seated within the aligned channel. As described above, universal pin 130 used to secure the higher masonry block 20 comprises both lower section 134 and upper section 136. In the next-lower course, set-back pin hole 92 of block 18A is aligned with the underlying set-back receiving slot 94 of block 18B, and universal pin 130 is seated within the aligned channel. Universal pin 130 that is used to secure the shorter masonry block 18A has had its top section 136 sheared off, and thus only includes lower section 134.

In the next-lower course, set-back pin hole 92 of block 18B is aligned with the underlying set-back receiving slot 64 of block 16A, and universal pin 130 is seated within the aligned channel. Universal pin 130 seated within masonry block 18B has had its top section 136 sheared off. In the next-lower course, set-back pin hole 62 is aligned with the underlying set-back receiving slot 94 of block 18C, and universal pin 130 is seated within the aligned channel. Universal pin 130 used to secure masonry block 16A comprises both lower section 134 and upper section 136. In the second lowest course, set-back pin hole 92 of block 18C is aligned with the underlying set-back receiving slot 64 of block 16B, and universal pin 130 is seated within the aligned channel. Universal pin 130 seated within block 18C has had its upper section 136 sheared off.

The same combination of masonry blocks 20A, 18A, 18B, 16A, 18C, and 16B is used to build a near-vertical retaining wall as illustrated in FIG. 14. In the top course, vertical pin hole 116 of block 20A is aligned with the underlying vertical receiving slot 98 of block 18A, and universal pin 130 is seated within the aligned channel. Universal pin 130 used to secure the higher masonry block 20A comprises both lower section 134 and upper section 136. Because vertical pinhole 116 is only slightly spaced forward of vertical receiving slot 118, a portion of the seated universal pin 130 is seated within vertical receiving slot 118.

In the next-lower course, vertical pin hole 96 of block 18A is aligned with the underlying vertical receiving slot 98 of block 18B, and universal pin 130 is seated within the aligned channel. Universal pin 130 seated within block 18A has had its upper section 136 sheared off. In the next-lower course, vertical pin hole 96 of block 18B is aligned with the underlying vertical receiving slot 68 of block 16A, and universal pin 130 is seated within the aligned channel. Universal pin 130 seated within block 18B has had its upper section 136 sheared off. In the next-lower course, vertical pin hole 66 of block 16A is aligned with the underlying vertical receiving slot 98 of block 18C, and universal pin 130 is seated within the aligned channel. Universal pin 130 seated within block 16A comprises both lower section 134 and upper section 136. In the second lowest course, vertical pin hole 96 of block 18C is aligned with the underlying vertical receiving slot 68 of block 16B, and universal pin 130 is seated within the aligned channel. Universal pin 130 seated within block 18C has had its upper section 136 sheared off.

As demonstrated by walls 170 and 180 of FIGS. 13 and 14; masonry blocks 16, 18 and 20 of the present invention can be used to build walls of varying slope by aligning respective pin holes with underlying receiving slots. A manufacturer can further vary the cant by manufacturing blocks with differing distances between pin holes and their respective receiving slots, therefore either increasing or decreasing the slope of the wall. Furthermore, a wall can be constructed with a varied slope throughout its height. During construction, certain masonry blocks or modules are secured along the near-vertical alignment, while other masonry blocks or modules are secured along the set-back or canted alignment. So that certain blocks, modules, or courses will be nearly vertical and others will be canted.

Although the preferred embodiment of the present invention described masonry blocks that are secured by pins, other securing or interlocking methods for mortarless masonry blocks are known in the art. Masonry blocks of the present invention can be manufactured with securing extensions such as feet, lips or flanges (and, if desired, associated recesses) for use in constructing the modular segmented wall of the present invention. Additionally, although the preferred embodiment included receiving slots, other receiving apertures are contemplated. Receiving apertures can very in size, shape, and depth, and a modification of the receiving aperture might require a modified securing pin consistent with the teachings of this invention. Furthermore, although the preferred embodiment described a retaining wall, the techniques of the present invention are equally applicable to any wall structure such as a free-standing wall, or the face of a building or a bridge.

Although the present invention has been described with reference to preferred embodiments, workers skilled in the art will recognize that changes may be made in form and detail without departing from the spirit and scope of the invention.

The invention claimed is:

1. A retaining wall structure comprising selected members of a set of interchangeable block modules of generally similar height and length arranged side-by-side and in successive courses, each member of the set having a different quadrilateral face pattern with four straight sides, each interchangeable module comprising a first row of a plurality of masonry blocks, the first row having a width, and a second row of a plurality of masonry blocks, the second row having a width generally equal to the width of the first row.

2. The retaining wall of claim 1, wherein each of the interchangeable block modules is comprised of up to three distinct masonry block types.

3. The retaining wall of claim 2, wherein the length of the first masonry block type plus the length of the second masonry block type equals twice the length of the third masonry block type.

4. The retaining wall of claim 2, wherein the length of the first masonry block type equals twice the length of the second masonry block type.

5. The retaining wall of claim 2, wherein each of the three distinct masonry block types is trapezoidal in shape.

6. The retaining wall of claim 2, wherein blocks of the first course and the second course are held together by at least one pin.

7. The retaining wall of claim 6, wherein the height of the three masonry block types is not equal, the length of the at least one pin accommodating the unequal height.

8. The retaining wall of claim 7, wherein the length of the at least one pin is adjustable.

9. The retaining wall structure of claim 1 wherein the first row has a first height and the second row has a second height, the first and second heights defining the height of each quadrilateral face pattern.

10. The retaining wall structure of claim 9 wherein the first height is different than the second height.

11. The retaining wall structure of claim 1 wherein a masonry block in a first course overlies two masonry blocks in an immediately adjacent second course.

12. The retaining wall structure of claim 1 wherein each of the masonry blocks of the first row has a width different than that of each of the masonry blocks of the second row.

13. The retaining wall structure of claim 1 wherein each of the interchangeable modules is separately constructed.

14. The retaining wall structure of claim 13, wherein the interchangeable modules are constructed along a row, creating a modular row.

15. The retaining wall structure of claim 1, wherein the masonry blocks are mortarless, and wherein the masonry blocks further comprise set-back pin holes and set-back receiving slots.

16. The retaining wall system of claim 15, further comprising retaining pins joining a set-back pin hole of a masonry block of the first row to a set-back receiving slot of a masonry block of the second row.

17. A retaining wall structure comprising:

a first interchangeable block module having a quadrilateral front face with four straight sides defining a height and a length of the first block module, the first block module having a first row of blocks and a second row of blocks positioned atop the first row of blocks, the first row of blocks defining a joint at the point of contact of adjacent blocks in the first row, the second row of blocks defining a joint at the point of contact of adjacent blocks of the second row, wherein the joint of the first row is offset from the joint of the second row;

a second interchangeable block module having a quadrilateral front face with four straight sides defining a height and a length of the second block module, the height and length of the second block module being substantially similar to the height and length of the first block module, the second block module having a first row of blocks and a second row of blocks positioned atop the first row of blocks, the first row of blocks defining a joint at the point of contact of adjacent blocks in the first row, the second row of blocks defining a joint at the point of contact of adjacent blocks of the second row, wherein the joint of the first row is offset from the joint of the second row, the first and second block modules having facing ends in contact with one another along the entire height of the respective first and second block modules;

a third interchangeable block module having a quadrilateral front face with four straight sides defining a height and a length of the third block module, the height and length of the third block module being substantially similar to the height and length of the first and second block modules, the third block module having a first row of blocks and a second row of blocks positioned atop the first row of blocks, the first row of blocks defining a joint at the point of contact of adjacent blocks in the first row, the second row of blocks defining a joint at the point of contact of adjacent blocks of the second row, wherein the joint of the first row is offset from the joint of the second row;

wherein the third block module is positioned to sit atop the first and second block modules and wherein the first, second, and third interchangeable block modules comprise selected members of a set of interchangeable block modules, each member of the set having a different quadrilateral face pattern.

* * * * *